US011708621B2

(12) United States Patent
Ebner et al.

(10) Patent No.: US 11,708,621 B2
(45) Date of Patent: Jul. 25, 2023

(54) STRIP FLOTATION FURNACE

(71) Applicant: EBNER Industrieofenbau GmbH, Leonding (AT)

(72) Inventors: Robert Ebner, Leonding (AT); Ulrich Pschebezin, Ansfelden (AT); Igor Grujic, Traun (AT); Alexander Pocherdorfer, Walding (AT)

(73) Assignee: EBNER Industrieofenbau GmbH, Leonding (AT)

( * ) Notice: Subject to any disclaimer, the term of this patent is extended or adjusted under 35 U.S.C. 154(b) by 123 days.

(21) Appl. No.: 17/433,013

(22) PCT Filed: Feb. 17, 2020

(86) PCT No.: PCT/EP2020/054081
§ 371 (c)(1),
(2) Date: Aug. 23, 2021

(87) PCT Pub. No.: WO2020/173738
PCT Pub. Date: Sep. 3, 2020

(65) Prior Publication Data

US 2022/0162719 A1 May 26, 2022

(30) Foreign Application Priority Data

Feb. 28, 2019 (DE) ..... 10 2019 105 167.3

(51) Int. Cl.
*C21D 9/00* (2006.01)
*F27B 9/24* (2006.01)
(Continued)

(52) U.S. Cl.
CPC ..... *C21D 9/0056* (2013.01); *B65H 20/14* (2013.01); *C21D 9/63* (2013.01); *F27B 9/2476* (2013.01);
(Continued)

(58) Field of Classification Search
CPC ..... B65H 20/14; C21D 9/0056; C21D 9/63; F27B 9/2476; F27B 9/28
(Continued)

(56) References Cited

U.S. PATENT DOCUMENTS 3,328,997 A * 7/1967 Beggs ..... C21D 9/63 72/364
3,456,930 A 7/1969 Saeki et al.
(Continued)

FOREIGN PATENT DOCUMENTS

CN 1427795 A 7/2003
CN 1440360 A 9/2003
(Continued)

OTHER PUBLICATIONS

Chinese Search Report dated Jul. 25, 2022 in Chinese Application No. 202080015077X (in Chinese).
(Continued)

*Primary Examiner* — Scott R Kastler
*Assistant Examiner* — Michael Aboagye
(74) *Attorney, Agent, or Firm* — Collard & Roe, P.C.

(57) ABSTRACT

A strip flotation furnace for controlling the temperature of a metal strip has a flotation nozzle bar extending through the furnace transversely to a strip running direction of the strip. The flotation nozzle bar has two opposing first flotation nozzle rows spaced apart by a central region of the flotation nozzle bar. The rows are set up so that corresponding flotation nozzle jets, with a directional component toward the central region, can be generated to provide pressure cushioning for metal strip guiding. A temperature-control nozzle bar extends transversely to and is spaced apart from the flotation nozzle bar along the strip running direction. The temperature-control nozzle bar has two additional opposing temperature-control nozzle rows spaced apart by an addi-
(Continued)

tional temperature-control nozzle bar central region. These rows are set up so that corresponding temperature-control nozzle jets, with a directional component opposite to the additional central region, can be generated.

13 Claims, 3 Drawing Sheets

(51) Int. Cl.
*F27B 9/28* (2006.01)
*C21D 9/63* (2006.01)
*B65H 20/14* (2006.01)

(52) U.S. Cl.
CPC ..... *F27B 9/28* (2013.01); *B65H 2406/11325* (2013.01); *B65H 2701/173* (2013.01)

(58) Field of Classification Search
USPC ..... 266/252; 34/643; 226/7
See application file for complete search history.

(56) References Cited

U.S. PATENT DOCUMENTS

| | | | | | |
|---|---|---|---|---|---|
| 3,549,070 | A | * | 12/1970 | Downham | B65H 23/24 34/448 |
| 3,823,488 | A | | 7/1974 | Houben et al. | |
| 5,156,312 | A | * | 10/1992 | Kurie | F26B 13/104 34/643 |
| 5,667,124 | A | * | 9/1997 | Bannenberg | F26B 13/104 242/615.11 |
| 5,829,166 | A | | 11/1998 | Klas | |
| 6,091,055 | A | * | 7/2000 | Naka | F27B 9/2476 29/DIG. 81 |
| 6,805,318 | B2 | * | 10/2004 | Ebner | F26B 13/104 242/615.11 |
| 11,072,834 | B2 | | 7/2021 | Schaefer et al. | |
| 2003/0047642 | A1 | | 3/2003 | Ebner | |
| 2019/0010568 | A1 | | 1/2019 | Kozuka et al. | |
| 2020/0025445 | A1 | | 1/2020 | Ebner et al. | |

FOREIGN PATENT DOCUMENTS

| | | | | | |
|---|---|---|---|---|---|
| CN | 108431250 | A | | 8/2018 | |
| CN | 109207706 | A | | 1/2019 | |
| DE | 33 1 8 861 | C1 | | 11/1984 | |
| DE | 103 06 509 | A1 | | 9/2004 | |
| EP | 0 728 847 | A1 | | 8/1996 | |
| EP | 0728847 | | * | 8/1996 | C21D 9/63 |
| EP | 0 807 591 | A1 | | 11/1997 | |
| GB | 1197636 | A | | 7/1970 | |
| GB | 2 141 989 | A | | 1/1985 | |
| JP | S48-36013 | A | | 5/1973 | |
| JP | H06-41649 | A | | 2/1994 | |
| JP | H08225858 | A | | 9/1996 | |
| JP | 2019014961 | A | | 1/2019 | |
| WO | 2018/162474 | A1 | | 9/2018 | |

OTHER PUBLICATIONS

International Search Report in PCT/EP2020/054081, dated May 12, 2020.

H.-J. Odenthal et al. "DPIV-Messungen am Kaltmodell eines Schwebebandofens für die Herstellung von NE-Metallband" (Jul. 31, 2003). Retrieved from the Internet: https://www.gala-ev.org/images/Beitraege/Beitraege 02003/pdf/47.pdf, [retrieved on Apr. 28, 2020], 9 pages—cited as category A in International Search Report.

* cited by examiner

STRIP FLOTATION FURNACE

CROSS REFERENCE TO RELATED APPLICATIONS

This application is the National Stage of PCT/EP2020/054081 filed on Feb. 17, 2020, which claims priority under 35 U.S.C. § 119 of German Application No. 102019105167.3 filed on Feb. 28, 2019, the disclosure of which is incorporated by reference. The international application under PCT article 21(2) was not published in English.

TECHNICAL FIELD

The present invention relates to a strip flotation furnace as well as to a method for operating a strip flotation furnace.

BACKGROUND OF THE INVENTION

Strip flotation furnaces are used for targeted heating and cooling of metal strips. In the strip flotation furnace, the metal strip is floatingly guided through the individual temperature zones. This results in that the metal strip may be guided through a corresponding strip flotation furnace without contact.

The floating state of the metal strip is generated by means of air jet cushions. In this regard, compressed air is made to stream against the metal strip to establish a floating condition of the metal strip. At the same time, the metal strip is guided through the strip flotation furnace along a strip running direction.

The temperature of the compressed air is correspondingly set in order to achieve a desired temperature control of the metal strip. In this regard, precise controlling of the temperature of the metal strip is often difficult and lossy.

DESCRIPTION OF THE INVENTION

It is an object of the present invention to provide an efficient strip flotation furnace and/or a strip flotation plant by means of which the temperature of a metal strip may be controlled in a precise and effective manner.

This object is achieved by a strip flotation furnace as well as a method for operating a strip flotation furnace according to the independent claims.

According to a first aspect of the present invention, a strip flotation furnace and/or a strip flotation plant for controlling the temperature (i.e. cooling or heating) of a metal strip is provided. The strip flotation furnace comprises a flotation nozzle bar, which extends through the strip flotation furnace transversely to a strip running direction of the metal strip. The flotation nozzle bar comprises two (or multiple) opposing first rows of flotation nozzles, which are spaced apart by a central region of the flotation nozzle bar, wherein the rows of flotation nozzles are configured such that corresponding flotation nozzle jets, with a directional component in the direction of the central region, can be generated in order to provide pressure cushioning for guiding the metal strip.

Moreover, the strip flotation furnace comprises a temperature-control nozzle bar, which extends transversely to a strip running direction of the metal strip and is spaced apart from the flotation nozzle bar along the strip running direction. The temperature-control nozzle bar comprises two (or multiple) additional opposing rows of temperature-control nozzles, which are spaced apart by an additional central region of the temperature-control nozzle bar. The rows of temperature-control nozzles are set up in such a way that corresponding temperature-control nozzle jets, with a directional component in the opposite direction to the additional central region, can be generated.

According to a further aspect of the present invention, a method for operating the strip flotation furnace for controlling the temperature of a metal strip described above is provided.

The strip flotation furnace and/or the strip flotation plant is configured to floatingly convey a metal strip along a conveying direction and/or along the strip running direction of the metal strip. At the same time, the strip flotation furnace is configured for bringing the metal strip to a desired temperature, i.e. to heat or cool it. For this purpose, the strip flotation furnace comprises the flotation nozzle bar and temperature-control nozzle bar described in further detail below. In addition to the mentioned nozzle bars, the strip flotation furnace may comprise additional heating or cooling devices. For example, induction heating elements, resistance heating elements or infrared heating elements can be arranged between the individual nozzle bars.

The metal strip is floatingly guided through a temperature-control zone of the strip flotation furnace. Within the temperature-control zone, there is a midplane which, in general, corresponds to a horizontal plane. The strip running direction is defined within the midplane, such that an entry of the strip flotation furnace and an exit of the strip flotation furnace are present along the strip running direction. In other words, the metal strip is conveyed from an entry of the strip flotation furnace to an exit of the strip flotation furnace along the strip running direction.

A flotation nozzle bar extends transversely, in particular at 90°, to the strip running direction. In particular, the flotation nozzle bar extends at least across the entire width of the metal strip. Corresponding rows of flotation nozzles, which are spaced apart by a central region of the flotation nozzle bar, are arranged at the two opposing longitudinal sides of the flotation nozzle bar. With reference to the strip running direction, a flotation nozzle bar thus comprises a front row of flotation nozzles and a rear row of flotation nozzles.

The rows of flotation nozzles are formed and configured such that flotation nozzle jets can be generated which may be streamed into the temperature-control zone of the strip flotation furnace in a predetermined and precisely defined direction with respect to the midplane. The rows of flotation nozzles according to the present invention are in particular formed such that the flotation nozzle jets of the corresponding rows of flotation nozzles each flow into the temperature-control zone in the direction of the central region, i.e. the middle of the flotation nozzle bar. In other words, the flotation nozzle jets each have a directional component which is directed in the direction of the central region of the flotation nozzle bar and correspondingly not outwardly, i.e. in the opposite direction to the central region. Hence, the flotation nozzle jets are bundled in the center, i.e. in a region above the central region, and a strong pressure cushioning is generated in the temperature-control zone above the central region of the flotation nozzle bar. This results in a high load capacity for carrying and/or deflecting/adjusting the position of the metal strip being possible.

A temperature-control nozzle bar extends transversely, in particular at 90°, to the strip running direction. In particular, the temperature-control nozzle bar extends at least across the entire width of the metal strip. Corresponding (two or more than two) rows of temperature-control nozzles, which are spaced apart by an additional central region of the temperature-control nozzle bar, are arranged at the two opposing longitudinal sides of the temperature-control nozzle bar.

With reference to the strip running direction, a temperature-control nozzle bar thus comprises a front row of temperature-control nozzles and a rear row of temperature-control nozzles.

The rows of temperature-control nozzles are formed and configured such that temperature-control nozzle jets can be generated which may be streamed into the temperature-control zone of the strip flotation furnace in a predetermined and precisely defined direction with respect to the midplane. The (two or more than two) rows of temperature-control nozzles according to the present invention are, in particular, formed such that the temperature-control nozzle jets of the corresponding rows of temperature-control nozzles each flow into the temperature-control zone in the opposite direction of the additional central region, i.e. away from the center of the temperature-control nozzle bar. In other words, the temperature-control nozzle jets each have a directional component which is directed in the opposite direction of the additional central region of the temperature-control nozzle bar and correspondingly not inwardly, i.e. in the direction towards the additional central region. Hence, the temperature-control nozzle jets are not bundled in the center, i.e. in a region above the additional central region, but the temperature-control nozzle jets distribute in the surrounding of the corresponding temperature-control nozzle bar.

Hence, as compare to the flotation nozzle bars, no strong pressure cushioning is created in the temperature-control zone. Due to this, a high volume flow of temperature-control fluid may be streamed in through the rows of temperature-control nozzles without generating a control of the pressure cushioning, which unintentionally deflects the position of the metal strip. At the same time, the high volume flow creates a high temperature-control effect of the metal strip by means of the temperature-control fluid.

Thus, with the present invention, a strip flotation furnace is created which allows for precise guiding by means of flotation nozzle bars and, at the same time, allows for effectively controlling the temperature of the metal strip by means of the temperature-control nozzle bars. The temperature-control nozzle bars and the flotation nozzle bars are for example connected to a common temperature-control fluid reservoir, such that these may be operated with a common temperature-control fluid. Alternatively, the temperature-control nozzle bars may be supplied with a different temperature-control fluid than the flotation nozzle bars.

According to a further exemplary embodiment, at least one of the rows of flotation nozzles comprises a plurality of separate flotation nozzles.

According to a further exemplary embodiment, at least one row of flotation nozzles comprises at least one slit nozzle which extends transversely to the strip running direction.

According to a further exemplary embodiment, the strip running direction is defined within a midplane of the strip flotation furnace, wherein at least one row of flotation nozzles is configured such that an angle $\alpha$ between the flotation nozzle jets and the midplane is 30° to 75°, in particular to 45°. Alternatively, the angle between the flotation nozzle jets and a normal of the midplane can be defined, which then has a range between 15° and 60°. The flotation nozzles of the rows of flotation nozzles are configured such that at their exit the temperature-control fluid is flowed radially in a predetermined direction in the direction of the temperature-control zone. The angle indications described above thus define flotation nozzle jets at the exit of the corresponding flotation nozzles. After having left the flotation nozzles, the flotation nozzle jets are deflected within the temperature-control zone according to the flow characteristics. With the described angle, a particularly strong pressure cushioning may be generated in the central region of the flotation nozzle bar.

According to a further exemplary embodiment, the opposing rows of flotation nozzles are designed such that an angle between the flotation nozzle jets of the one row of flotation nozzles and an angle between the flotation nozzle jets of the other row of flotation nozzles differ from one another. Hence, the position of the pressure cushioning may be easily adjusted in the strip running direction within the central region.

According to a further exemplary embodiment, a support region is formed between the rows of flotation nozzles in the central region, said support region being configured such that the metal strip may be placed on the support region. In particular, the support region projects further into the temperature-control zone than a corresponding nozzle exit of the corresponding rows of flotation nozzles. During a starting process or in case of a fault of the strip flotation furnace, the metal strip may thus gently be placed on the support region.

According to a further exemplary embodiment, the support region comprises nozzle openings for the discharge of fluid. In particular, a perforated plate, which has a plurality of nozzle holes, may be arranged at the support region.

By means of the fluid flowing in through the perforated plate, for example, the shape and the strength of the pressure cushioning may be influenced.

According to a further exemplary embodiment, at least one of the rows of temperature-control nozzles comprises a plurality of separate temperature-control nozzles. According to a further exemplary embodiment, at least one row of temperature-control nozzles comprises at least one slit nozzle which extends transversely to the strip running direction. The individual temperature-control nozzles may have a rectangular exit cross section. The inclination angle may be varied in a range between 0° and 45°.

According to a further exemplary embodiment, the strip running direction is defined within a midplane of the strip flotation furnace, wherein at least one row of temperature-control nozzles are configured such that an angle $\beta$ between the temperature-control nozzle jets and a normal n of the midplane is 0° to 30° or 45°, in particular to 15°. Thus, the temperature-control nozzle jets stream relatively directly onto the metal strip, such that impact jets are enabled. By means of impact jets, efficient heat exchange between the metal strip and the temperature-control fluid may be enabled.

According to a further exemplary embodiment, the rows of temperature-control nozzles are designed such that an angle between the temperature-control nozzle jets of the one row of temperature-control nozzles and an angle between the temperature-control nozzle jets of the other row of temperature-control nozzles differ from one another.

According to a further exemplary embodiment, an open channel directed towards the metal strip and/or the temperature-control zone is formed between the rows of temperature-control nozzles. The open channel results in that the temperature-control fluid, which flows back from the metal strip and, in particular, bounces back due to the impact jetting, may flow into the open channel, and be discharged. Thus, the pressure, which is generated by the temperature-control nozzle jets is reduced, since the volume between the temperature-control nozzle bars and the metal strip is enlarged by means of the open channel.

According to a further exemplary embodiment, the strip flotation furnace comprises a plurality of flotation nozzle bars and/or a plurality of temperature-control nozzle bars. The number depends on the desired temperature control performance and the conveying path of the metal strip in the strip flotation furnace.

According to a further exemplary embodiment, at least one temperature-control nozzle bar is arranged between two flotation nozzle bars spaced apart in the strip running direction (which are both located below or above the metal strip and/or the temperature-control zone). In particular, precisely one temperature-control nozzle bar or a further plurality of temperature-control nozzle bars may be arranged between two adjacent flotation nozzle bars.

According to a further exemplary embodiment, the temperature-control zone, by means of which the metal strip may be conveyed, is formed within the strip flotation furnace, wherein the flotation nozzle bars are arranged above and below the temperature-control zone.

According to a further exemplary embodiment, the upper flotation nozzle bars are arranged so as to be offset from the lower flotation nozzle bars in the strip running direction. Thus, along a connection line defined perpendicularly to the midplane of the furnace, no upper and lower flotation nozzle bars lie together on this connection line. In an exemplary embodiment, the lower flotation nozzle bars and the lower temperature-control nozzle bars are arranged alternately, i.e. in turns, along the strip running direction. Accordingly, the upper flotation nozzle bars and the upper temperature-control nozzle bars are arranged alternately, i.e. in turns, along the strip running direction. Moreover, the flotation nozzle bars and the temperature-control nozzle bars are arranged such that on the connection line described above, which is formed perpendicularly to the midplane, one (upper or lower) temperature-control nozzle bar and one (correspondingly lower or upper) flotation nozzle bar are arranged on opposite sides of the temperature-control zone, in each case. This results in that a pressure cushioning of the flotation nozzle bars is always formed only on one side of the metal strip, i.e. at the top or at the bottom, and a further pressure cushioning of a further flotation nozzle bar is spaced apart in the strip running direction and is formed on the other side of the metal strip. This allows the metal strip to assume a sinusoidal shape in the longitudinal direction, i.e. in the strip running direction, thus reducing the risk of twisting of the metal strip.

According to a further exemplary embodiment, the temperature-control nozzle bars are arranged merely above or below, i.e. merely on one side of, the temperature-control zone through which the metal strip can be conveyed. Thus, the temperature of the metal strip can be controlled stronger on one side, i.e. on the top side or bottom side, than on an opposite side of the metal strip, in a targeted manner.

According to a further exemplary embodiment, a temperature-control nozzle bar is arranged opposite to a flotation nozzle bar with respect to the temperature-control zone. Since, as described in the beginning, the flotation nozzle bars create a stronger pressure cushioning and the temperature-control nozzle bars apply a higher temperature-control effect, thus, a sinusoidal shape of the metal strip may be generated and, at the same, a good temperature-control effect across the entire length of the metal strip may be provided.

For stable strip running of the metal strip, primarily flotation nozzle bars are used. For this purpose, a pressure cushioning is established directly above the flotation nozzle bar, such that with the arrangement of the flotation nozzle bars described above, a sinusoidal strip deformation occurs. This provides stable strip running. Both strip vibrations and fluttering of the metal strip are reduced. The design of the flotation nozzle also has a centering effect, which is intended to reduce lateral strip wander. The flotation nozzle jets generate a heat transfer with the temperature-control fluid.

The flotation nozzle bars consist of two main flow channels and/or rows of flotation nozzles. In the symmetrical design, these have the same inclination angle, in the asymmetrical design, the two inclination angles differ from one another. The inclination angle is varied in a range between 30° and 75°. The perforated plate is intended on the one hand to maintain the pressure cushioning above the nozzle, and on the other hand the heat transfer is somewhat improved. The size of the main channels and/or the rows of flotation nozzles can also be varied and/or the two exit areas can differ from each other.

The temperature-control nozzle bars have a very low pressure loss coefficient, such that at the same pressure and/or power level as with the flotation nozzle bars, a significantly higher nozzle exit velocity can be achieved than with the flotation nozzle bar. This is reflected in a higher heat transfer coefficient with the metal strip, such that the temperature-control nozzle bars allow higher forced convection.

The temperature-control nozzle bars can have a smaller nozzle exit area than the flotation nozzle bars. Due to the smaller nozzle exit area, the accumulation pressure area is relatively small compared to the flotation nozzle bars and the accumulation pressure area always forms locally above the nozzle finger and/or the rows of temperature-control nozzles. As a result, the temperature-control nozzle bar counteracts the impulse force exerted by the flotation nozzle bar on the metal strip to a relatively small extent.

The height of the fingers and/or rows of temperature-control nozzles may be constructed such that a uniform velocity distribution across the entire strip width may be ensured.

It should be noted that the presently described embodiments merely represent a limited selection of possible embodiment variants of the invention. Thus, it is possible to combine the features of individual embodiments in a suitable manner, so that for the person skilled in the art, a plurality of different embodiments are to be regarded as obviously disclosed with the embodiment variants made explicit herein. In particular, some embodiments of the invention are described by device claims and other embodiments of the invention are described by method claims. However, it will immediately become clear to the person skilled in the art upon reading this application that, unless explicitly stated otherwise, in addition to a combination of features belonging to one type of subject matter of the invention, any combination of features belonging to different types of subject matters of the invention is also possible.

BRIEF DESCRIPTION OF THE DRAWINGS

Below, for further explanation and better understanding of the present invention, exemplary embodiments will be described in further detail making reference to the enclosed drawings. These show.

DETAILED DESCRIPTION OF EXEMPLARY EMBODIMENTS

Equal or similar components are provided with equal reference numbers in different figures. The representations in the figures are schematic.

Figure 1:
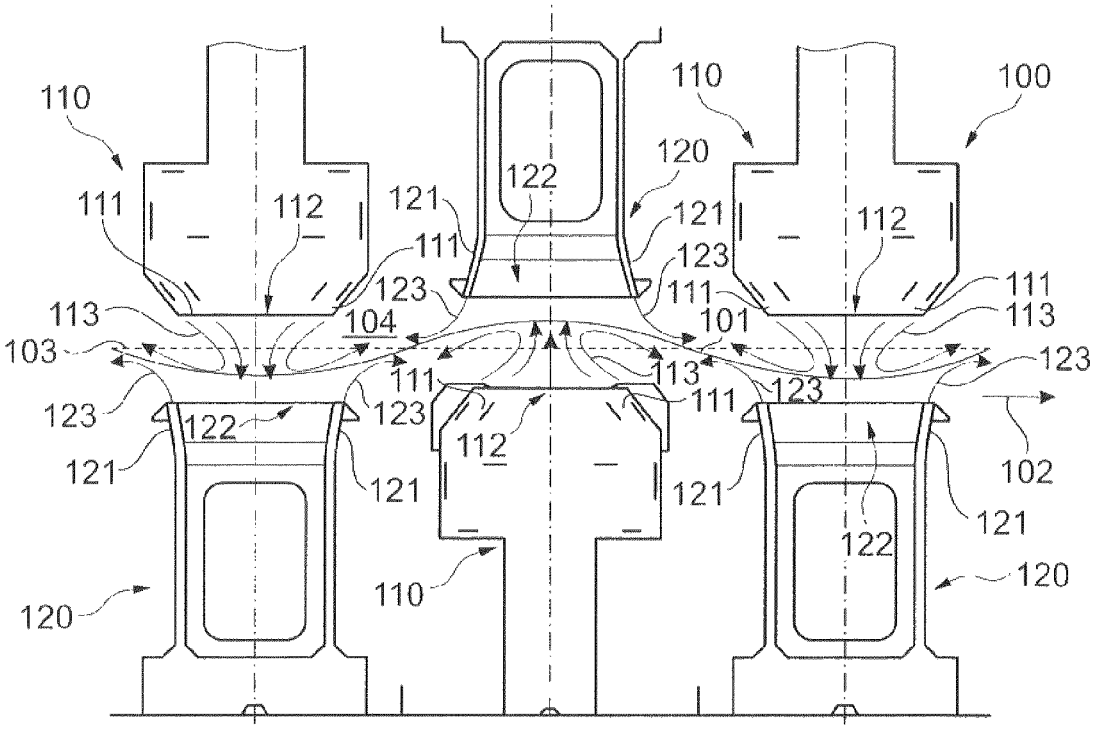
FIG. 1 a schematic representation of a strip flotation furnace according to an exemplary design of the present invention.

FIG. 1 shows a schematic representation of a strip flotation furnace 100 for controlling the temperature of a metal strip 101 according to an exemplary design of the present invention. The strip flotation furnace 100 has a flotation nozzle bar 110, which extends through the strip flotation furnace 100 transversely to a strip running direction 102 of the metal strip 101, wherein the flotation nozzle bar 110 has two opposing first rows of flotation nozzles 111, which are spaced apart by a central region 112 of the flotation nozzle bar 110. The rows of flotation nozzles 111 are set up in such a way that corresponding flotation nozzle jets 113, with a directional component in the direction of the central region 112, can be generated in order to provide pressure cushioning for guiding the metal strip 101. The strip flotation furnace 100 also has a temperature-control nozzle bar 120, which extends transversely to a strip running direction 102 of the metal strip 101 and is spaced apart from the flotation nozzle bar 110 along the strip running direction 102, wherein the temperature-control nozzle bar 120 has two additional opposing rows of temperature-control nozzles 121, which are spaced apart by an additional central region 122 of the temperature-control nozzle bar 120. The rows of temperature-control nozzles 121 are set up in such a way that corresponding temperature-control nozzle jets 123, with a directional component in the opposite direction to the additional central region 122, can be generated.

The strip flotation furnace 100 is configured to floatingly convey the metal strip 101 along a conveying direction and/or along the strip running direction 102. At the same time, the strip flotation furnace is 100 configured for bringing the metal strip 101 to a desired temperature, i.e. to heat or cool it. The strip flotation furnace 100 comprises flotation nozzle bars 110 and temperature-control nozzle bars 120 for this purpose.

The metal strip 101 is floatingly guided through a temperature-control zone 104 of the strip flotation furnace 100. Within the temperature-control zone 104, there is a midplane 103 which, in general, corresponds to a horizontal plane. The strip running direction 102 is defined within the midplane 103, such that an entry of the strip flotation furnace 100 and an exit of the strip flotation furnace 100 are present along the strip running direction 102. In other words, the metal strip 101 is conveyed from an entry of the strip flotation furnace 100 to an exit of the strip flotation furnace 100 along the strip running direction 102.

The flotation nozzle bars 110 extend transversely, in particular at 90°, to the strip running direction 102. Corresponding rows of flotation nozzles 111, which are spaced apart by a central region 112 of the flotation nozzle bar 110, are arranged at the two opposing longitudinal sides of the flotation nozzle bar 110. With reference to the strip running direction 102, a flotation nozzle bar 110 thus comprises a front row of flotation nozzles 111 and a rear row of flotation nozzles 111.

The rows of flotation nozzles 111 are formed and configured such that flotation nozzle jets 113 can be generated which may be streamed into the temperature-control zone 104 of the strip flotation furnace 100 in a predetermined and precisely defined direction with respect to the midplane 103. The rows of flotation nozzles 111 are formed such that the flotation nozzle jets 113 of the corresponding rows of flotation nozzles 111 each flow into the temperature-control zone 104 in the direction of the central region 112, i.e. the middle of the flotation nozzle bar 100. In other words, the flotation nozzle jets 113 each have a directional component which is directed in the direction of the central region 112 of the flotation nozzle bar 110 and correspondingly not outwardly, i.e. in the opposite direction to the central region 112. Hence, the flotation nozzle jets 113 are bundled in the center, i.e. in a region above the central region 112, and a strong pressure cushioning is generated in the temperature-control zone 104 above the central region 112 of the flotation nozzle bar 110. This results in a high load capacity for carrying and/or deflecting/adjusting the position of the metal strip 101 being possible.

A temperature-control nozzle bar 120 extend transversely, in particular at 90°, to the strip running direction 102. In particular, the temperature-control nozzle bar 120 extends at least across the entire width of the metal strip 101. Corresponding rows of temperature-control nozzles 121, which are spaced apart by a central region 112 of the temperature-control nozzle bar 120, are arranged at the two opposing longitudinal sides of the temperature-control nozzle bar 120. With reference to the strip running direction 104, a temperature-control nozzle bar 120 thus comprises a front row of temperature-control nozzles 121 and a rear row of temperature-control nozzles 121.

The rows of temperature-control nozzles 121 are formed and configured such that temperature-control nozzle jets 123 can be generated which may be streamed into the temperature-control zone 104 of the strip flotation furnace in a predetermined and precisely defined direction with respect to the midplane 103. The rows of temperature-control nozzles 121 according to the present invention are, in particular, formed such that the temperature-control nozzle jets 123 of the corresponding rows of temperature-control nozzles 121 each flow into the temperature-control zone 104 in the opposite direction of the additional central region 122, i.e. away from the center of the temperature-control nozzle bar 120. In other words, the temperature-control nozzle jets 123 each have a directional component which is directed in the opposite direction of the additional central region 122 of the temperature-control nozzle bar 120 and correspondingly not inwardly, i.e. in the direction towards the additional central region 122. Hence, the temperature-control nozzle jets 123 are not bundled in the additional center 122, i.e. in a region above the additional central region 122, but the temperature-control nozzle jets 123 distribute in the surrounding of the corresponding temperature-control nozzle bar 120.

Hence, as compare to the flotation nozzle bars 120, no strong pressure cushioning is created in the temperature-control zone 104. Due to this, a high volume flow of temperature-control fluid may be streamed in through the rows of temperature-control nozzles 123 without generating a control of the pressure cushioning, which unintentionally deflects the position of the metal strip 101. At the same time, the high volume flow creates a high temperature-control effect of the metal strip 101 by means of the temperature-control fluid.

The strip flotation furnace 100 of FIG. 1 comprises a plurality of flotation nozzle bars 110 and a plurality of temperature-control nozzle bars 120. The number depends on the desired temperature-control performance and the conveying path of the metal strip 101 in the strip flotation furnace 100.

In the exemplary embodiment, at least one temperature-control nozzle bar 120 is arranged between two flotation nozzle bars 110 spaced apart in the strip running direction 102 (which are both located below or above the metal strip 101 and/or the temperature-control zone 104). The flotation nozzle bars 110 and the temperature-control nozzle bars 120 are arranged above and below the temperature-control zone.

The upper flotation nozzle bars 110 are arranged so as to be offset from the lower flotation nozzle bars 110 in the strip running direction 102. Thus, along a connection line defined perpendicularly to the midplane 103 of the strip flotation furnace 100, no upper and lower flotation nozzle bars 110 lie together on this connection line. The lower flotation nozzle bars 110 and the lower temperature-control nozzle bars 120 are arranged alternately, i.e. in turns, along the strip running direction 102. Accordingly, the upper flotation nozzle bars 110 and the upper temperature-control nozzle bars 120 are arranged alternately, i.e. in turns, along the strip running direction 102. Moreover, the flotation nozzle bars 110 and the temperature-control nozzle bars 120 are arranged such that on the connection line described above, which is formed perpendicularly to the midplane 103, one (upper or lower) temperature-control nozzle bar 120 and one (correspondingly lower or upper) flotation nozzle bar 110 are arranged on opposite sides of the temperature-control zone 104, in each case. This results in that a pressure cushioning of the flotation nozzle bars 110 is always formed only on one side of the metal strip 101, i.e. at the top or at the bottom, and a further pressure cushioning of a further flotation nozzle bar 110 is spaced apart in the strip running direction 102 and is formed on the other side of the metal strip 101. This allows the metal strip 101 to assume a sinusoidal shape in the longitudinal direction, i.e. in the strip running direction 102, thus reducing the risk of twisting of the metal strip 101.

Moreover, a temperature-control nozzle bar 120 is arranged opposite to a flotation nozzle bar 110 with respect to the temperature-control zone 104. Since the flotation nozzle bars 110 create a stronger pressure cushioning and the temperature-control nozzle bars 120 apply a higher temperature-control effect, thus, a sinusoidal shape of the metal strip 101 may be generated and, at the same, a good temperature-control effect across the entire length of the metal strip 101 may be provided.

Figure 2:
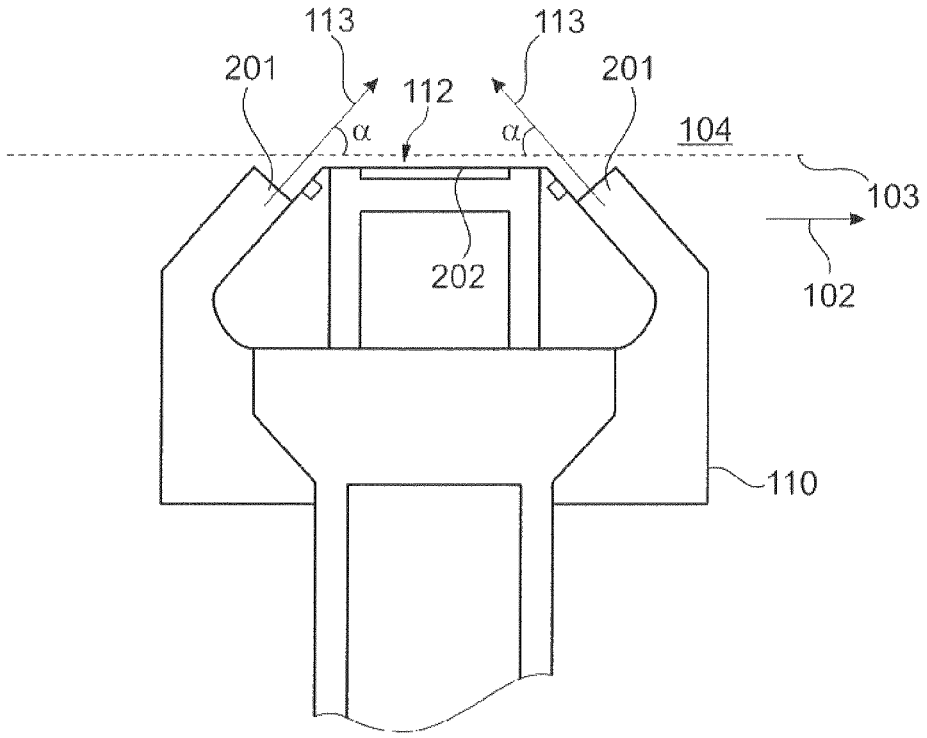
FIG. 2 a sectional representation of a flotation nozzle bar according to an exemplary embodiment of the present invention.
Figure 3:
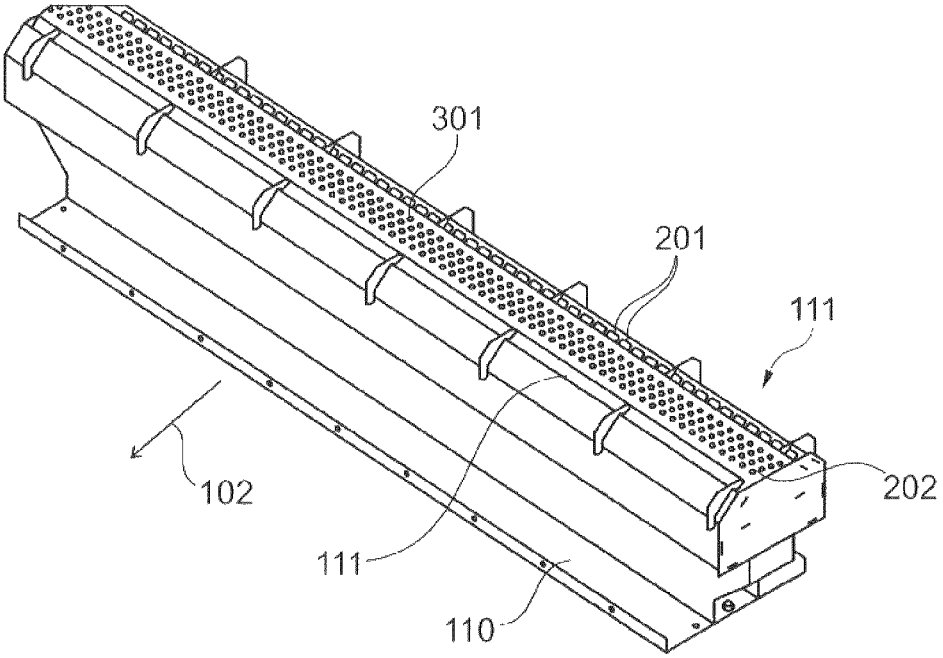
FIG. 3 a perspective representation of the flotation nozzle bar from FIG. 2.

FIG. 2 shows a sectional representation and FIG. 3 shows a perspective representation of a flotation nozzle bar 110 according to an exemplary embodiment of the present invention.

The rows of flotation nozzles 111 each comprise a plurality of separate flotation nozzles 201. The individual flotation nozzles 201 may have a rectangular exit cross section.

A row of flotation nozzles 111 is designed such that an angle α between the flotation nozzle jets and the midplane 103 is 45°. The flotation nozzles 201 of the rows of flotation nozzles are configured such that at their exit the flotation nozzle jets 113 flow radially in a predetermined direction in the direction of the temperature-control zone 104. After having left the flotation nozzles 201, the flotation nozzle jets 113 are deflected within the temperature-control zone 104 according to the flow characteristics (see flow arrows in FIG. 1). Hence, a particularly strong pressure cushioning is generated in the central region 112 of the flotation nozzle bar 110.

A support region 202 is formed between the rows of flotation nozzles 111 in the central region 112, said support region being configured such that the metal strip 101 may be placed on the support region 202. In particular, the support region 202 projects further into the temperature-control zone 104 than a corresponding nozzle exit of the corresponding rows of flotation nozzles 111. During a starting process or in case of a fault of the strip flotation furnace 100, the metal strip 101 may thus gently be placed on the support region 202.

The support region 202 comprises nozzle openings 301 for the discharge of fluid. In particular, a perforated plate, which has a plurality of nozzle holes 301, is arranged at the support region 202.

Figure 4:
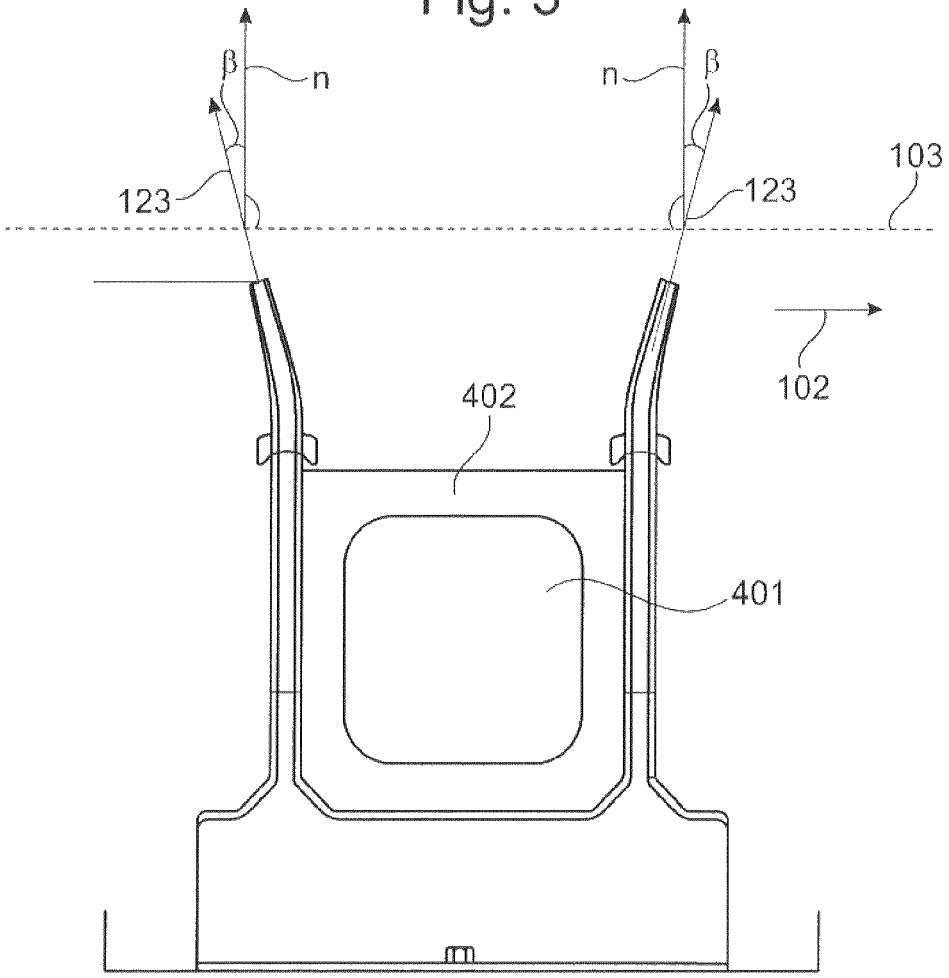
FIG. 4 a sectional representation of a temperature-control nozzle bar according to an exemplary embodiment of the present invention.
Figure 5:
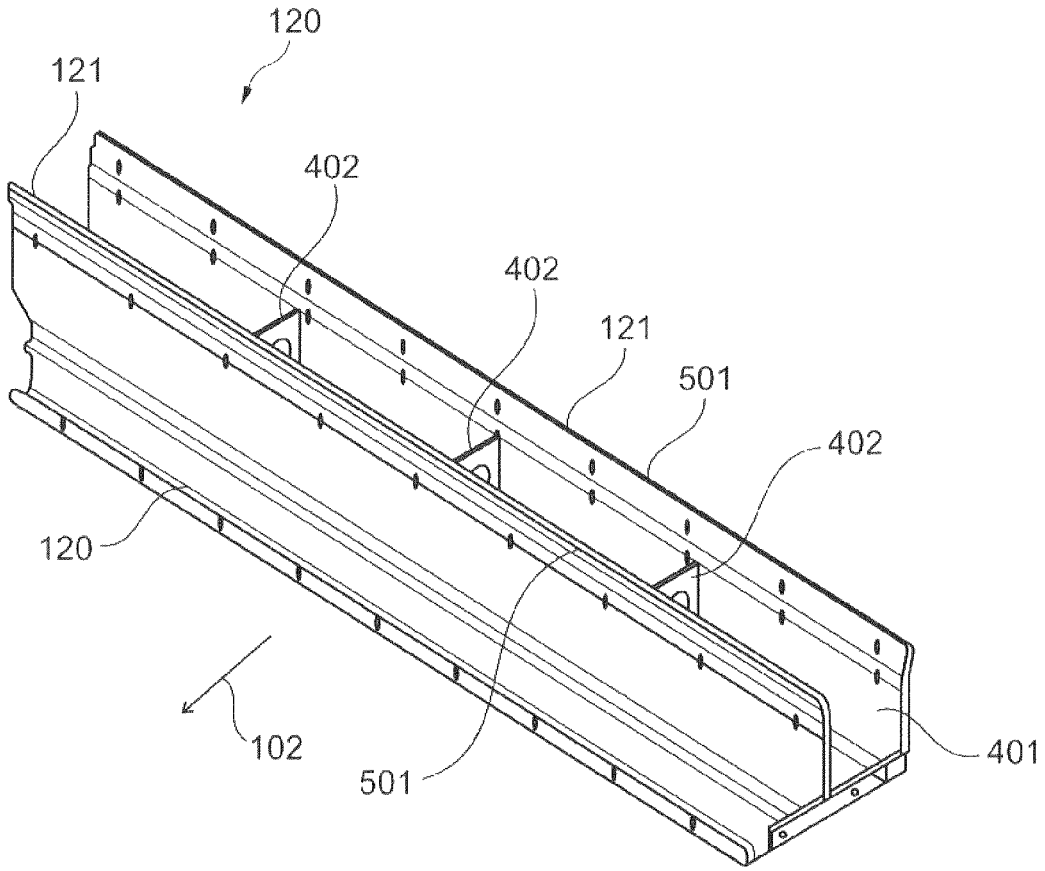
FIG. 5 a perspective representation of the temperature-control nozzle bar from FIG. 4.

FIG. 4 shows a sectional representation and FIG. 5 shows a perspective representation of a temperature-control nozzle bar 120 according to an exemplary embodiment of the present invention.

The temperature-control nozzle bar 120 comprises at least one slit nozzle 501 which extends transversely to the strip running direction 102. The temperature-control nozzles are narrow and assume a finger-like shape in cross-section. The individual temperature-control nozzles may have a rectangular exit cross section. An angle β is approximately 15° between the temperature-control nozzle jets 123 and the normal n of the midplane. Thus, the temperature-control nozzle jets 123 stream relatively directly onto the metal strip 101, such that impact jets are enabled. By means of impact jets, efficient heat exchange between the metal strip 102 and the temperature-control fluid may be enabled.

An open channel 401 directed towards the metal strip 101 and/or the temperature-control zone 104 is formed between the rows of temperature-control nozzles 121. The open channel 401 results in that the temperature-control fluid, which flows back from the metal strip 101 and, in particular, bounces back due to the impact jetting, may flow into the open channel 401 and be discharged. Thus, the pressure, which is generated by the temperature-control nozzle jets is reduced, since the volume between the temperature-control nozzle bars 120 and the metal strip 101 is enlarged by means of the open channel 401. Stiffening struts 402 are provided between the rows of temperature-control nozzles 121 so as to provide sufficient stability despite the open channel 401.

Additionally, it should be noted that "comprising" does not preclude other elements or steps, and "one" or "a" does not preclude a plurality. Moreover, it should be noted that features or steps that have been described with reference to one of the above exemplary embodiments may also be used in combination with other features or steps of other exemplary embodiments described above. Reference numbers in the claims are not to be regarded as a limitation.

LIST OF REFERENCE NUMBERS

100 Strip flotation furnace
101 Metal strip
102 Strip running direction
103 Midplane
104 Temperature-control zone
110 Flotation nozzle bar
111 Rows of flotation nozzles
112 Central region
113 Flotation nozzle jets
120 Temperature-control nozzle bar

121 Row of temperature-control nozzles
122 Further central region
123 Temperature-control nozzle jets
201 Flotation nozzles
202 Support region
301 Nozzle openings
401 Open channel
402 Stiffening strut
501 Slit nozzle
α Angle of flotation nozzle jets
β Angle of temperature-control nozzle jets
n Normal

The invention claimed is:

1. A strip flotation furnace (100) for controlling the temperature of a metal strip (101), the strip flotation furnace (100) comprising:

a plurality of flotation nozzle bars (110), each flotation bar of the plurality of flotation bars extending through the strip flotation furnace (100) transversely to a strip running direction (102) of the metal strip (101), wherein each flotation nozzle bar (110) of the plurality of flotation bars has two opposing first rows of flotation nozzles (111), which are spaced apart by a central region (112) of the flotation nozzle bar (110), wherein the rows of flotation nozzles (111) are configured in such a way that corresponding flotation nozzle jets (113), with a directional component in the direction of the central region (112), can be generated in order to provide pressure cushioning for guiding the metal strip (101), a plurality of temperature-control nozzle bars (120) having a smaller nozzle exit area than the flotation nozzle bars, each temperature-control nozzle bar of the plurality of temperature-control nozzle bars extending transversely to a strip running direction (102) of the metal strip (101) and is spaced apart from a corresponding flotation nozzle bar (110) along the strip running direction (102), wherein each temperature-control nozzle bar (120) of the plurality of temperature-control nozzle bars has two opposing additional rows of temperature-control nozzles (121), which are spaced apart by an additional central region (122) of the temperature-control nozzle bar (120), wherein the rows of temperature-control nozzles (121) are configured in such a way that corresponding temperature-control nozzle jets (123), with a directional component in the opposite direction to the additional central region (122), can be generated to temperature control the metal strip as the metal strip is being guided, wherein at least one temperature-control nozzle bar (120) is arranged between two flotation nozzle bars (110) spaced apart in the strip running direction (102), wherein a temperature-control zone (104), by means of which the metal strip (101) may be conveyed, is formed within the strip flotation furnace (100), wherein the flotation nozzle bars (110) are arranged above and below the temperature-control zone (104), wherein upper flotation nozzle bars (110) are arranged so as to be offset from lower flotation nozzle bars (110) in the strip running direction (102), wherein a temperature-control nozzle bar (120) is arranged opposite to a flotation nozzle bar (110) with respect to the temperature-control zone (104), and wherein the lower flotation nozzle bars and lower temperature-control nozzle bars are arranged alternately along the strip running direction and the upper flotation bars and upper temperature-control nozzle bars are arranged alternately along the strip running direction.

2. The strip flotation furnace (100) according to claim 1, wherein at least one row of flotation nozzles comprises a plurality of separate flotation nozzles (201).

3. The strip flotation furnace (100) according to claim 1, wherein at least one row of flotation nozzles comprises at least one slit nozzle which extends transversely to the strip running direction (102).

4. The strip flotation furnace (100) according to claim 1, wherein the strip running direction (102) is defined within a midplane (103) of the strip flotation furnace (100), wherein at least one row of flotation nozzles (111) is designed such that an angle (a) between the flotation nozzle jets (113) and the midplane (103) is 30° to 75°.

5. The strip flotation furnace (100) according to claim 1, wherein the rows of flotation nozzles (111) are designed such that an angle between the flotation nozzle jets (113) of the one row of flotation nozzles (111) and an angle (a) between the flotation nozzle jets (113) of the other row of flotation nozzles (111) differ from one another.

6. The strip flotation furnace (100) according to claim 1, wherein a support region (202) is formed between the rows of flotation nozzles (111) in the central region (112), said support region (202) being configured such that the metal strip (101) may be placed on the support region (202).

7. The strip flotation furnace (100) according to claim 1, wherein the support region (202) comprises nozzle openings (301) for the discharge of fluid.

8. The strip flotation furnace (100) according to claim 1, wherein at least one row of temperature-control nozzles (121) comprises a plurality of separate temperature-control nozzles.

9. The strip flotation furnace (100) according to claim 1, wherein at least one row of temperature-control nozzles comprises at least one slit nozzle (501) which extends transversely to the strip running direction (102).

10. The strip flotation furnace (100) according to claim 1, wherein the strip running direction (102) is defined within a midplane (103) of the strip flotation furnace (100), wherein at least one row of temperature-control nozzles (121) is designed such that an angle (β) between the temperature-control nozzle jets (123) and a normal (n) of the midplane (103) is 0° to 30°.

11. The strip flotation furnace (100) according to claim 1, wherein the rows of temperature-control nozzles (121) are designed such that an angle between the temperature-control nozzle jets (123) of the one row of temperature-control nozzles (121) and an angle (β) between the temperature-control nozzle jets (123) of the other row of temperature-control nozzles differ from one another.

12. The strip flotation furnace (100) according to claim 1, wherein an open channel (401) directed towards the metal strip (101) is formed between the rows of temperature-control nozzles (121).

13. The strip flotation furnace (100) according to claim 1, wherein the temperature-control nozzle bars (120) are arranged merely above or below a temperature-control zone (104) through which the metal strip (101) can be conveyed.

* * * * *